US007429066B2

(12) United States Patent
Sementilli

(10) Patent No.: US 7,429,066 B2
(45) Date of Patent: Sep. 30, 2008

(54) EMBEDDED ELECTRIC LOCK

(75) Inventor: Domenico Sementilli, Aprilia (IT)

(73) Assignee: Serrature Meroni S.p.A., Nova Milanese (Milan) (IT)

( * ) Notice: Subject to any disclaimer, the term of this patent is extended or adjusted under 35 U.S.C. 154(b) by 0 days.

(21) Appl. No.: 10/564,090

(22) PCT Filed: Jul. 12, 2004

(86) PCT No.: PCT/EP2004/051464

§ 371 (c)(1),
(2), (4) Date: Jun. 23, 2006

(87) PCT Pub. No.: WO2005/012674

PCT Pub. Date: Feb. 10, 2005

(65) Prior Publication Data

US 2006/0267357 A1 Nov. 30, 2006

(30) Foreign Application Priority Data

Jul. 15, 2003 (IT) ..... TO2003A0546

(51) Int. Cl.
*E05C 1/06* (2006.01)

(52) U.S. Cl. ..... 292/144; 70/277

(58) Field of Classification Search ..... 292/144, 292/341.16; 70/277, 280

See application file for complete search history.

(56) References Cited

U.S. PATENT DOCUMENTS 4,929,003 A * 5/1990 McConnell ..... 292/144
5,911,460 A * 6/1999 Hawkins et al. ..... 292/254
6,022,056 A * 2/2000 Cope et al. ..... 292/144
6,580,355 B1 * 6/2003 Milo ..... 340/5.7
6,848,729 B2 * 2/2005 Caspi et al. ..... 292/341.16

FOREIGN PATENT DOCUMENTS

DE 266 253 C 10/1913
DE 298 04 032 U 5/1998
DE 199 51 621 A 5/2001

* cited by examiner

*Primary Examiner*—Gary Estremsky
(74) *Attorney, Agent, or Firm*—Hogan & Hartson LLP

(57) ABSTRACT

A body (14) of the electric lock, embedded in a jamb of a fixed frame, contains an electromechanical release device comprising a loading bolt (28) suitable to be retracted in the body (14). A pusher (34) is movable between a retracted position in the body (14) and a forward position in a selvage (26) to expel from the selvage (26) the nose (20) of the lock and release the latter. There are provided elastic means (52) for the pusher (34) to be returned to the forward position. An escapement system (44) is suitable to hold the pusher (34) at the retracted position. A kinematic mechanism (46) interlocks the loading bolt (28) and the escapement system (44) such that, when the loading bolt (28) is caused to retract, the pusher (34) is held at the retracted position by the escapement system (44); when an electromagnet (42) is excited, the escapement system (44) releases the pusher (34), which is snapped to the forward position to expel the nose (20).

6 Claims, 5 Drawing Sheets

E
A
22
10
18
C
24
20
12
32
28
16
F1
14
D
B

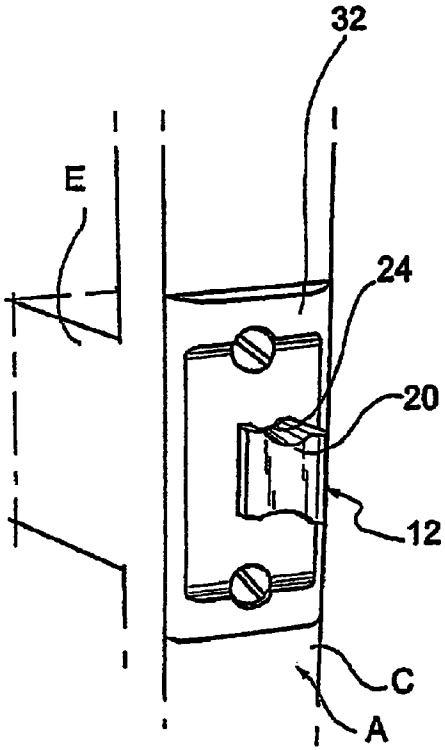
Fig.2
Fig.3
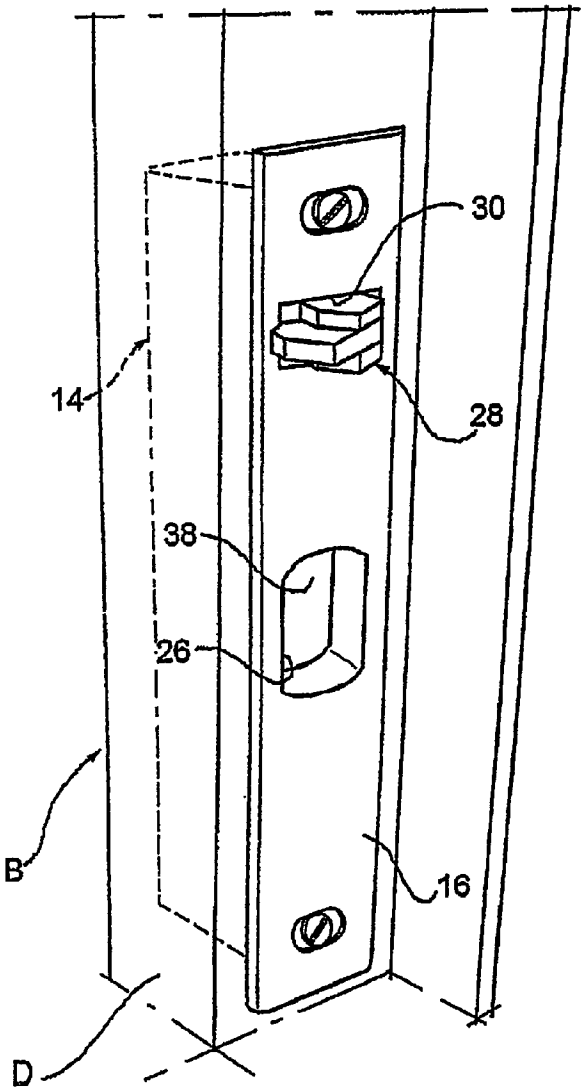

Fig.4
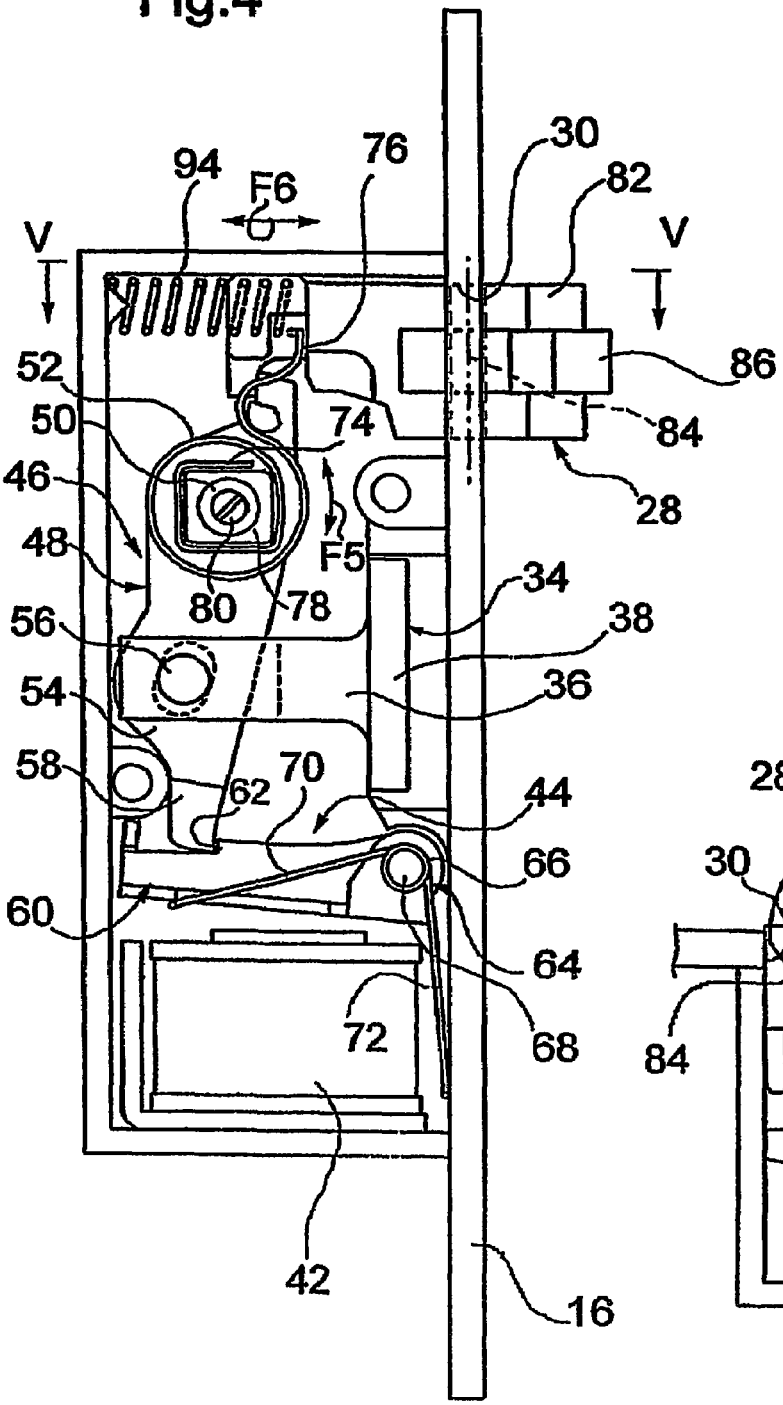
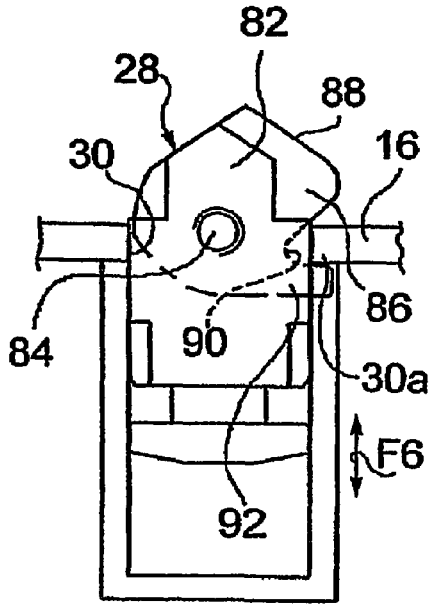
Fig.5

EMBEDDED ELECTRIC LOCK

FIELD OF THE INVENTION

The present invention relates to an embedded electric lock. Particularly, the present invention relates to an embedded electric lock of the type comprising a first case body which can be mounted embedded on a jamb of a moving frame of a window and door frame and has a first head wall, and a second case body which can be mounted embedded on a corresponding jamb of a fixed frame of the window and door frame and which has a second head wall, wherein the first body carries a latchbolt with an end beveled nose and elastic means to cause the latchbolt to return to a closing position of the lock. The above mentioned nose protrudes through an opening in the first head wall, wherein the second head wall has a selvage for the nose to be engaged therein in the closing position of the window and door frame to lock the moving frame relative to fixed frame, and wherein the second body carries an electromechanical release device to controllably disengage the nose from the selvage.

BACKGROUND OF THE INVENTION

The electric locks of the subject type are advantageous in that both bodies thereof can be mounted in an invisible manner within suitable cavities, either being already present or purposely formed, in the corresponding jambs of the moving and fixed frames of a window and door frame, thereby improving the appearance thereof.

In those types of embedded electric locks referred to by the invention, and such as stated in the preamble of Claim 1, the electromechanical release device, also indicated with the name of electric striker, is carried within the second body of the electric lock, i.e. within the body mounted on the fixed frame. This system is advantageous in that the electric cables connecting the electromagnet of the electromechanical device to the outside are not subjected to damaging torsion or wear contrarily to the case where the electromechanical release device is mounted on the first body of the electric lock, i.e. on the moving frame.

In the known electric locks of the subject type, the selvage formed in the second body has a moving lateral side and the electromechanical release device is arranged such that, when the electromagnet thereof is excited to unlock the window and door frame, it allows the moving side to open on the side of the jamb. This solution mostly nullifies both the technical and aesthetic advantages of the electric locks of the subject type: on the one hand, the installer should carry out an accurate and often awkward work in order to remove the jamb lateral wall for the moving side to pass therethrough in order to be opened; on the other hand, by being visible, the moving side partially nullifies the remarkable appearance provided by concealing the electric lock within the window and door frame.

SUMMARY OF THE INVENTION

The object of the invention is to provide an electric lock being advantageous in that both bodies thereof can be mounted in an invisible manner in suitable cavities, either being already present or purposely formed in the corresponding jambs of the moving and fixed frames of a window and door frame, thereby improving appearance and reducing installation costs.

According to the invention, this object is achieved by means of an embedded electric lock according to the appended claims.

By installing the second body of an electric lock according to the invention in a jamb of a fixed frame of a window and door frame, the removal of material from the jamb side is not required, because the very two organs cooperating with the head wall and the nose of the first body, i.e. the loading bolt and the pusher, are arranged at the head wall of the second body.

The invention will be better understood by reading the description below, which is given by way of a non-limiting example with reference to the annexed drawings illustrating a preferred embodiment thereof.

BRIEF DESCRIPTION OF THE DRAWINGS

FIG. 2 is a different perspective view partially illustrating only the moving frame of the window and door frame and the corresponding portion of the same electric lock, FIG. 3 is a different perspective view partially illustrating only the fixed frame of the window and door frame and the corresponding portion of the same electric lock, FIG. 4 is a side elevational view of the lock portion from FIG. 3, without a side wall thereof and in the state where the window and door frame is open, FIG. 5 is a section taken along line V-V from FIG. 4.

DETAILED DESCRIPTION OF THE PREFERRED EMBODIMENTS

Figure 1:
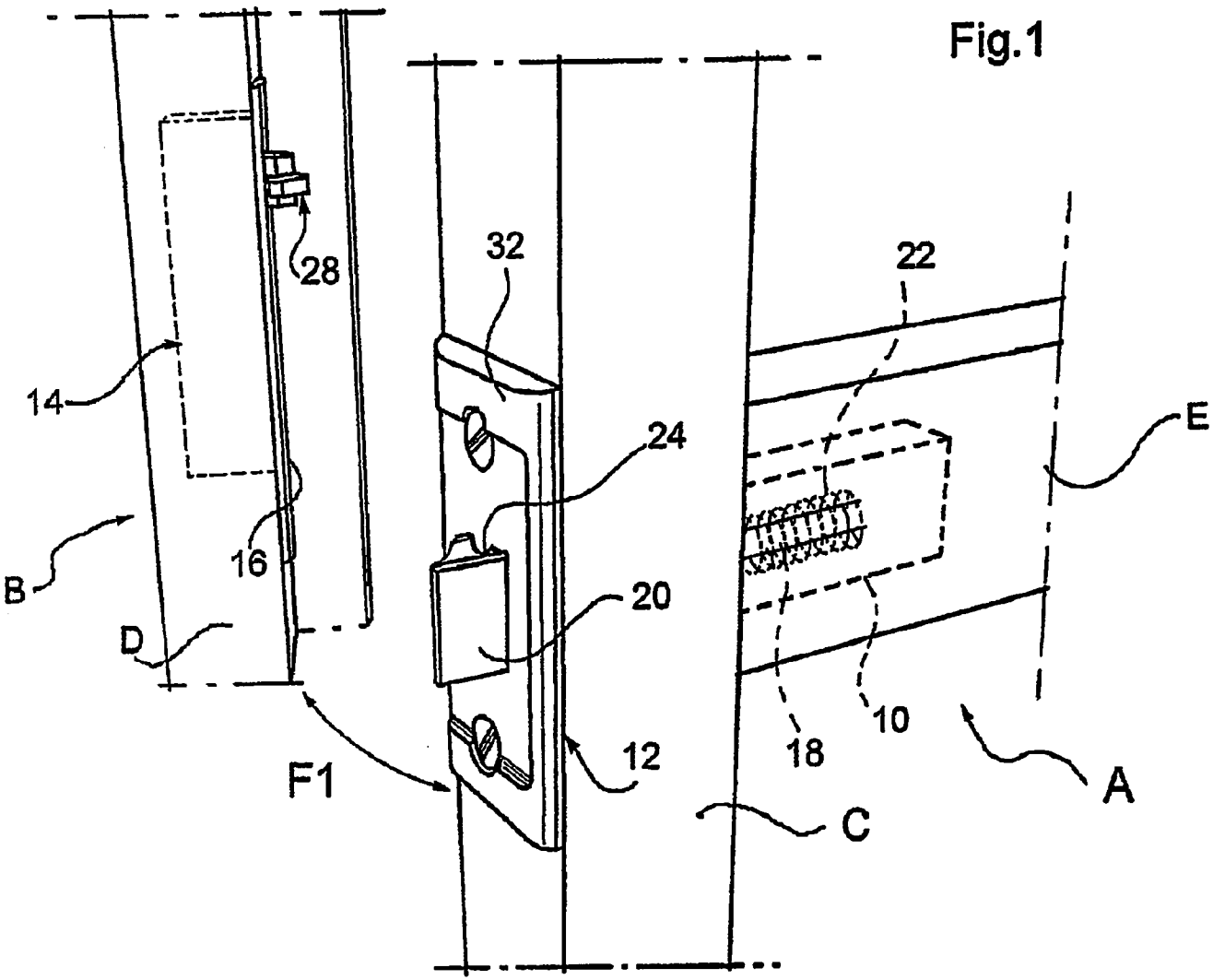
FIG. 1 is a perspective view partially illustrating a moving frame and a fixed frame of a window and door frame on which the corresponding portions of an electric lock according to the invention are mounted.

With reference to FIGS. 1 to 3, a window and door frame, such as a door or a door window, comprises a moving frame A and a fixed frame B.

In the FIGS. 1 to 3 there are partially illustrated frames A and B which, though consisting of section bars by way of a non-limiting example, they may nevertheless be made of wood and the like.

The moving frame A is hinged to the fixed frame B such as to be able to swing according to the double arrow F1 from FIG. 1.

A jamb of the moving frame A and a jamb of the fixed frame B matching when the window and door frame is closed have been designated with C and D, respectively; a hollow crosspiece of the moving frame A has been designated with E.

The depicted window and door frame is provided with an electric lock according to the invention, consisting of two separate portions, the first being mounted embedded on the jamb C of the moving frame and on the crosspiece E thereof, and the other being mounted embedded on the jamb D of the fixed frame B.

The portion of the electric lock carried on the moving frame A comprises a first case body 10 having a first head wall 12; the portion of the electric lock carried on the fixed frame B comprises a second case body 14 having a second head wall 16.

The first body 10 contains, as in the prior art (FIG. 1), a latchbolt in the form of a rod 18, with an end beveled nose 20, and a spring 22 (or similar elastic means) to cause the latchbolt 18 to return to a closing position of the lock, where the nose 20 protrudes, such as in FIGS. 1 and 2, through an opening 24 in the first head wall 12.

The second head wall 16 has a selvage 26 (FIG. 3) where the nose 20 can be engaged in the closing position of the window and door frame to lock the moving frame A relative to the fixed frame B.

The second body 14 carries an electromechanical release device to controllably disengage the nose 20 from selvage 26, which will be now described in detail with reference to FIGS. 4 to 9.

In the second body 14 there is provided a loading bolt, also being illustrated in FIGS. 1 and 3, and designated as a whole with 28.

The loading bolt 28 is caused to elastically return, in the manner which will be described below, to a position where it protrudes (FIGS. 4 and 5) through an opening 30 in the second head wall, and is suitable to be caused to retract within the second body 14 and held in the retracted position (FIGS. 6 to 9) under the thrust of a protruding transversal track 32 of the first head wall 12.

In the second body 14 there is also provided a pusher 34, with a shank 36 and a head 38 sliding within the selvage 26.

The pusher 34 is movable between a retracted position in the second body 14 (FIGS. 4 and 6) and a position where the head 38 thereof is caused to move forward in the selvage 26 (28) to expel the nose 20 from the selvage 26 and release the lock, such as will be better described below.

In the second body 14 there are provided elastic means for the pusher 34 to be returned to the forward position from FIG. 8, which will be described below.

Again, in the second body 14 there is provided an electromagnet 42, to be excited in order to release the lock.

Figure 8:
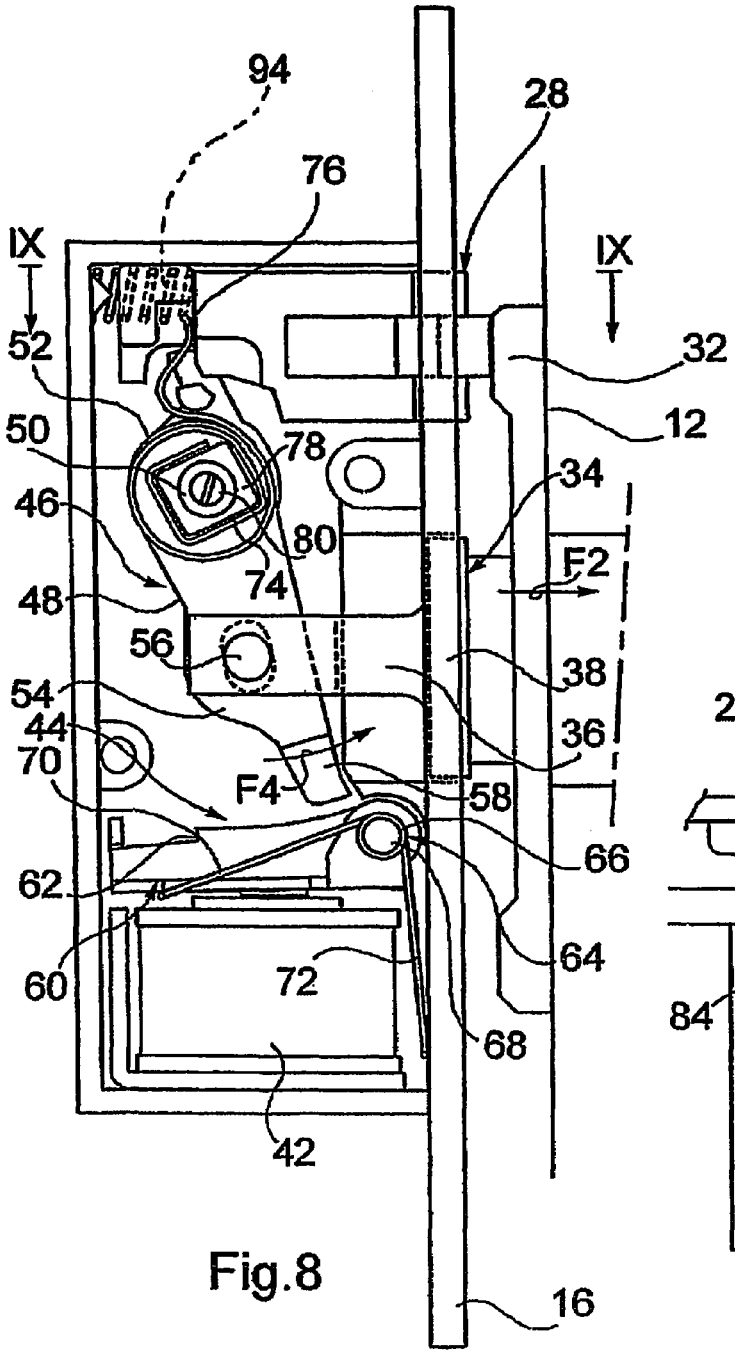
FIG. 8 is a similar view to FIG. 6, in the state where the window and door frame is in the opening step and where there are again partially illustrated the moving frame and the lock portion associated thereto.

To the electromagnet 42 there is associated an escapement system designated as a whole with 44, which is suitable to hold the pusher 34 at the retracted position from FIG. 4 and release it to allow the head 38 thereof to be moved to the forward position from FIG. 8 when the electromagnet 42 is excited.

The loading bolt 28 and the escapement system 44 are interlocked by a kinematic mechanism designated as a whole with 46.

Figure 6:
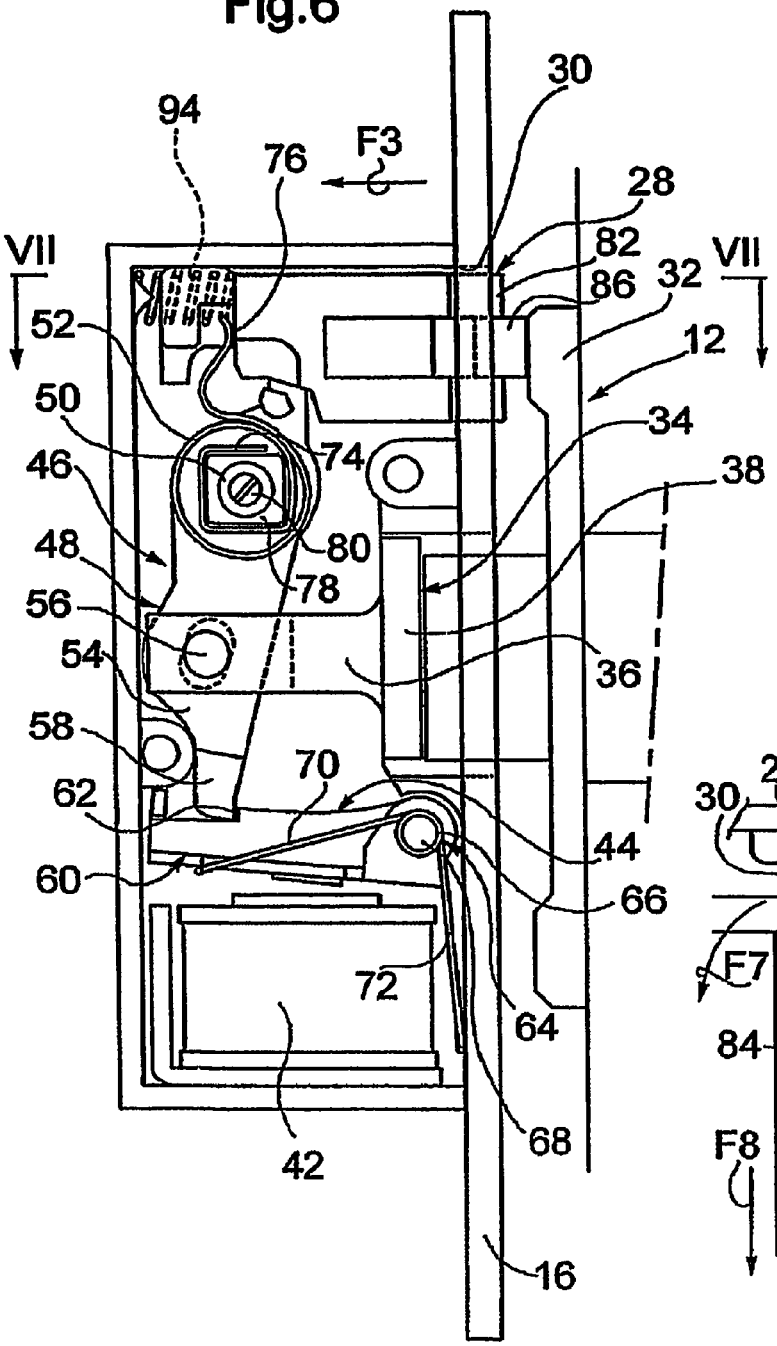
FIG. 6 is a similar view to FIG. 4, in the state where the window and door frame is in the closing step or has been closed and where there are also partially illustrated the moving frame and the lock portion associated thereto.

The kinematic mechanism 46 is such that, when the loading bolt 28 is caused to retract in the second body 14 upon closing the window and door frame (FIGS. 6 and 7) and the electromagnet 42 is de-excited, the pusher 34 is held at the retracted position from FIG. 6 by the escapement system 44; when, such as in FIG. 8, the electromagnet 42 is excited, the escapement system 44 releases the pusher 34 and the elastic repulsing means of the latter unload and cause it to move to the forward position from FIG. 8.

A preferred embodiment of the kinematic mechanism 46 interlocking the loading bolt 28 and the escapement system 44 will be now described with reference to FIGS. 4, 6 and 8.

This kinematic mechanism 46 comprises a rocker idler arm 48 with a fulcrum 50 placed between the loading bolt 28 and the pusher 34.

The idler arm 48 comprises a spring arm 52 engaged by the loading bolt 28 and an opposite rigid arm 54.

The rigid arm 54 is tied to the shank 36 of the pusher 34 by means of a trunnion 56 and has an escapement end tooth 58 which prolongates the arm towards the electromagnet 42.

To the electromagnet 42 there is associated an anchor 60 in the form of a swinging finger, which anchor is movable by magnetic attraction towards the electromagnet 42 and is elastically returned to a moved away position from the electromagnet 42 (FIG. 8).

The anchor 60 has a stop groove 62 against which the escapement tooth 58 engages when the anchor 60 is in the moved away position illustrated in FIG. 6, in order to prevent that the idler arm 48 may move in the direction (F2, FIG. 8) corresponding to the movement of the pusher 34 towards the forward position through the selvage 26.

Figure 7:
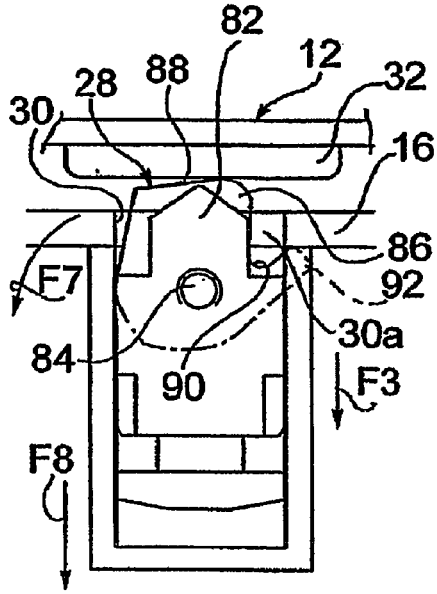
FIG. 7 is a section taken along line VII-VII from FIG. 6.

The arrangement is such that when the loading bolt 28 is caused to retract such as indicated by the arrows F3 in FIGS. 6 and 7, the idler arm 48, due to the engagement of the escapement tooth 58 thereof with the stop groove 62 of the anchor 60, is kept still in a position corresponding to the retaining of the pusher 34 in the retracted position from FIG. 6, and said spring arm 52 is elastically loaded.

On the contrary, when the anchor 60 is attracted by the electromagnet 42, such as in FIG. 8, the stop groove 62 disengages from the escapement tooth 58 and the idler arm 48 snaps, according to the arrow F4 from FIG. 8, to lead the pusher 34 to the forward position from FIG. 8 due to the elastic tension of the spring arm 52 being unloaded.

Still with reference to FIGS. 4, 6 and 8, the swinging finger being the anchor 60 is elastically returned to the moved away position from the electromagnet 42 by a spring 64 with a turn portion 66 wound around a pin 68 being the fulcrum of finger 60 and with two branches 70, 72 which tend to elastically approach each other, the first one, 70 abutting against the anchor 60 and the second one, 72, the second head wall 16 or a different fixed wall of second body 14.

Still preferably, such as shown in FIGS. 4, 6 and 8, the spring arm 52 consists of a spiral spring wound around a pin being the fulcrum 50 of the idler arm 48.

The spring 52 comprises a central portion 74 being integral with the pin or fulcrum 50 and a peripheral appendix 76 substantially radial against which an inner end of the loading bolt 28 opposite to that corresponding to the second head wall 14 is abutted.

Still preferably, the pin or fulcrum 50 of the idler arm 48 carries a square bush 78 around which the central portion 74 of the spiral spring 52 is keyed, which central portion 74 is in the form of a square turn.

Still preferably, the angular position of the square bush 78 relative to pin 50 can be set according to the double arrow F5 from FIG. 4 in order to adjust the elastic load of spring 52, and the adjustment thus obtained can be maintained by tightening a clamp screw 80 of the bush 78.

Figure 9:
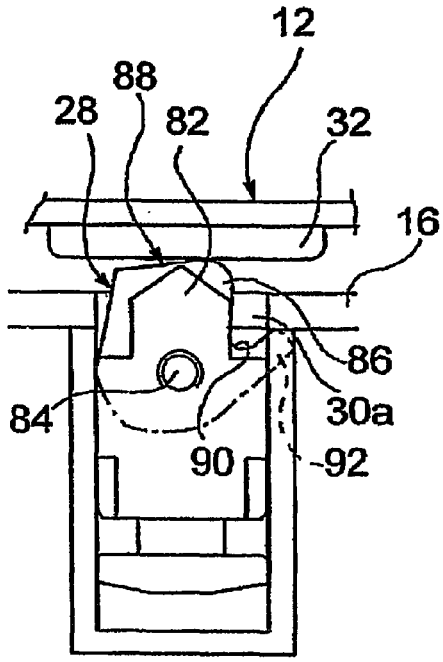
FIG. 9 is a section taken along line IX-IX from FIG. 8.

In the preferred embodiment, particularly illustrated in FIGS. 5, 7 and 9, the loading bolt 28 comprises a loading nose 82 linearly slidable, according to the double arrow F6 from FIGS. 4 and 5, between the protruding position from FIGS. 4 and 5 and the retracted position of FIGS. 6 and 7.

In the loading nose 82 there is pivotally mounted, around a pin 84, a cam 86 having a beveled face 88 to be engaged with the protruding track 32 of the first head wall 12, such as in FIG. 7.

The cam 88 has a side notch 90 suitable to encompass a side edge 30*a* of the corresponding opening 30 of second head wall 14, and a finger 92 to be engaged behind edge 30*a*.

The arrangement is such that, when the first head wall 12 engages the beveled face 88 of cam 86 in the closing direction of the movable frame A, such as in FIG. 7, the cam 86 is caused to rotate according to arrow F7 from FIG. 7, relative to the loading nose 82 around a fulcrum defined by the engagement of finger 92 with said side edge, and such rotation of the cam 86 is turned, with a force-multiplying effect, to a linear retracting movement of the loading nose 86, such as indicated by arrow F8 in FIG. 7.

Preferably, in addition to the action of the spring arm or spiral spring 52 of the rocker idler arm 48, the loading nose 82 is elastically sent back to the forward position from FIGS. 4 and 5 by a helical compression spring 94, which is independent from the spring arm 52 and interposed between the bolt 82 and a fixed wall of second body 14.

The invention claimed is:

1. Embedded electric lock, of the type comprising a first case body which can be mounted embedded on a jamb of a moving frame of a window and door frame and has a first head wall, and a second case body which can be mounted embedded on a corresponding jamb of a fixed frame of the window and door frame and which has a second head wall, wherein the first body carries a latchbolt with an end beveled nose and elastic means to cause the latchbolt to return to a closing position of the lock, where the nose protrudes through an opening in the first head wall, wherein the second head wall has a selvage for the nose to be engaged therein in the closing position of the window and door frame to lock the moving frame relative to fixed frame, and wherein the second body carries an electromechanical release device to controllably disengage the nose from the selvage, characterized in that the electromechanical release device comprises:

a loading bolt elastically returned to a position where it protrudes from an opening of the second head wall, and suitable to be caused to retract within the second body and be held at the retracted position under the thrust of the first head wall, a pusher movable between a retracted position in the second body and a forward position in the selvage to expel the nose from selvage and release the lock, elastic means to repulse the pusher to the forward position, an electromagnet that can be excited to release the lock, an escapement system associated to the electromagnet, suitable to hold the pusher at the retracted position and to release the pusher to allow it being moved to the forward position when the electromagnet is excited, and a kinematic mechanism interconnecting the loading bolt and the escapement system such that, when the loading bolt is caused to retract in the second body and the electromagnet is deexcited, the pusher is held at the retracted position of the escapement system, and when the electromagnet is excited, the escapement system releases the pusher and the elastic means are unloaded and move it to the forward position, characterized in that the kinematic mechanism interconnecting the loading bolt and the escapement system comprises:

a rocker idler arm with a fulcrum placed between the loading bolt and the pusher, with a spring arm engaged by the loading bolt, with an opposite rigid arm tied to the pusher and with an end escapement tooth prolongating the rigid arm towards the electromagnet, and an anchor in the form of a swinging finger movable by magnetic attraction towards the electromagnet and elastically returned to a moved away position from the electromagnet, the anchor having a stop groove against which the escapement tooth engages when the anchor is at said moved away position, to prevent that the idler arm may move in the direction corresponding to the motion of the pusher towards the forward position through the selvage, the arrangement being such that when the loading bolt is caused to retract, the idler arm, due to the engagement of the escapement tooth thereof with the stop groove of the anchor, is held stopped in a position corresponding to the retaining of the pusher at the retracted position and said spring arm is elastically loaded, whereas when the anchor is attracted by the electromagnet the stop groove disengages from the escapement tooth and the idler arm snaps to bring the pusher to the forward position due to the elastic tension of the spring arm being unloaded.

2. Electric lock according to claim 1, characterized in that the spring arm consists of a spiral spring wound around a pin being the fulcrum of the idler arm, having a central portion integral with the pin and having a substantially radial peripheral appendix against which an end of the loading bolt opposite the one corresponding to the second head wall is abutted.

3. Electric lock according to claim 2, characterized in that the pin of the idler arm carries a square bush around which a square central turn of the spiral spring is keyed, and in that the angular position of the square bush relative to the pin can be set to the purpose of adjusting the elastic load of the spring.

4. Electric lock according to claim 1, characterized in that the swinging finger being the anchor is elastically returned to the moved away position from the electromagnet by a spring with a turn portion wound around a pin being the fulcrum of finger and with two branches tending to elastically approach each other, and the first one abutting against the anchor and the second one against a stationary inner portion of second body.

5. Electric lock according to claim 1, characterized in that the loading bolt comprises a loading nose linearly sliding between the protruding and retracted positions and a cam rotatable within the loading nose, having a beveled face to be engaged by the first head wall and having a side notch suitable to encompass a side edge of the corresponding opening of second head wall and a finger to be engaged behind the side edge, according to such an arrangement that when the first head wall engages the beveled face of the cam in the closing direction of the moving frame, the cam is caused to rotate relative to the loading nose around a fulcrum being defined by the engagement of finger to said side edge, and this rotation of cam is turned, by a force-multiplying effect, to a linear backward movement of the loading nose.

6. Electric lock according to claim 1, characterized in that the loading bolt is elastically sent back to the forward position by a compression helix spring, independent from the spring arm of the rocker idler arm and interposed between the bolt and a stationary wall of second body.

* * * * *